US012733721B1

(12) United States Patent
Vaughn

(10) Patent No.: US 12,733,721 B1
(45) Date of Patent: Sep. 15, 2026

(54) BANK CARD HOLDING DEVICE FOR MOBILE PHONES

(71) Applicant: Clarence Vaughn, Lindenwold, NJ (US)

(72) Inventor: Clarence Vaughn, Lindenwold, NJ (US)

( * ) Notice: Subject to any disclaimer, the term of this patent is extended or adjusted under 35 U.S.C. 154(b) by 32 days.

(21) Appl. No.: 18/808,531

(22) Filed: Aug. 19, 2024

(51) Int. Cl.
*A45C 11/18* (2006.01)
*A45C 15/06* (2006.01)
*A45C 11/00* (2006.01)

(52) U.S. Cl.
CPC ..... *A45C 11/182* (2013.01); *A45C 15/06* (2013.01); *A45C 11/002* (2025.01)

(58) Field of Classification Search
CPC ..... A45F 5/1516; A45F 5/155; A45C 11/182; A45C 15/06; A45C 11/002; A45C 2001/065; A47B 2200/0094; A47B 21/045; A47B 63/06; F16M 13/022; Y10S 248/918; G06F 1/1611; G06F 2200/1613
USPC ..... 224/576; 248/918
See application file for complete search history.

(56) References Cited

U.S. PATENT DOCUMENTS 4,805,680 A * 2/1989 Ueno ..... A45C 11/182 359/809
5,697,594 A * 12/1997 Adams ..... A47B 21/045 248/442.2
5,999,336 A * 12/1999 Yang, Jr. ..... G02B 3/08 359/802
6,427,837 B1 * 8/2002 Shields ..... A45C 1/06 150/147
7,385,508 B1 * 6/2008 Ray ..... G08B 13/149 340/568.1
7,641,046 B2 * 1/2010 Tsang ..... A45C 13/008 206/320
9,339,094 B2 * 5/2016 Tucker-Skow ..... A45C 11/182
10,078,256 B2 * 9/2018 Ghabour ..... G03B 17/56
2010/0038514 A1 * 2/2010 Yu ..... G06F 1/1686 248/458
2012/0067473 A1 * 3/2012 Khounsombath ..... A45C 1/06 150/147
2014/0140049 A1 * 5/2014 Cotelo ..... H04M 1/04 362/184
2017/0293150 A1 10/2017 Montoya
2022/0400173 A1 * 12/2022 Gangwal ..... H04M 1/0264
2023/0309670 A1 * 10/2023 Vaudreuil ..... A45C 11/182 224/666

* cited by examiner

*Primary Examiner* — Adam J Waggenspack

(74) *Attorney, Agent, or Firm* — Sanchelima & Associates, P.A.; Christian Sanchelima; Jesus Sanchelima

(57) ABSTRACT

A bank card holding device for mobile phones including a card holder assembly and a mounting assembly. The mounting assembly pivotally attaches the card holder assembly to a mobile phone. The card holder assembly is an illuminated magnifying device. The card holder assembly is configured to receive a bank card to magnify and illuminate the information displayed on the bank card for easy identification of the information.

8 Claims, 4 Drawing Sheets

BANK CARD HOLDING DEVICE FOR MOBILE PHONES

BACKGROUND OF THE INVENTION

1. Field of the Invention

The present invention relates to bank card holding devices and, more particularly, to a bank card holding device for mobile phones that includes a card holder attachable to computerized devices such as mobile phones.

2. Description of the Related Art

Several designs for card holding devices have been designed in the past. None of them, however, include a bank card holding device for mobile phones that comprises a card holder assembly that can be attached to a mobile phone or integrated to a mobile device case, the card holder has a magnifying portion to magnify the card information.

Applicant believes that a related reference corresponds to U.S. patent Application No. 2017/0293150 issued for a mobile devise case with a magnifying member for enlarging the text displayed on the mobile device screen. Applicant believes that another related reference corresponds to U.S. patent Application No. 2014/0140049 issued for an electronic device case with a deployable and illuminated magnifying mechanism. None of these references, however, teach of a bank card holding device for mobile phones that is comprised of an illuminated magnifying device that is attached to or built into a mobile phone, where the device is configured to pivotally hold and display a credit card and is used to illuminate and magnify the information displayed on the card.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a bank card holding device for mobile phones that can be easily attached to computerized devices to allow users to consult the card information when online purchasing.

It is another object of this invention to provide a bank card holding device for mobile phones that includes a card holder with a magnifying device that magnifies the card information for better reading and identification of the information.

It is still another object of the present invention to provide a bank card holding device for mobile phones that has a card holder with lights to illuminate the card for easy information identification.

It is yet another object of the present invention to provide a bank card holding device for mobile phones that is pivotally integrated to a smartphone case.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
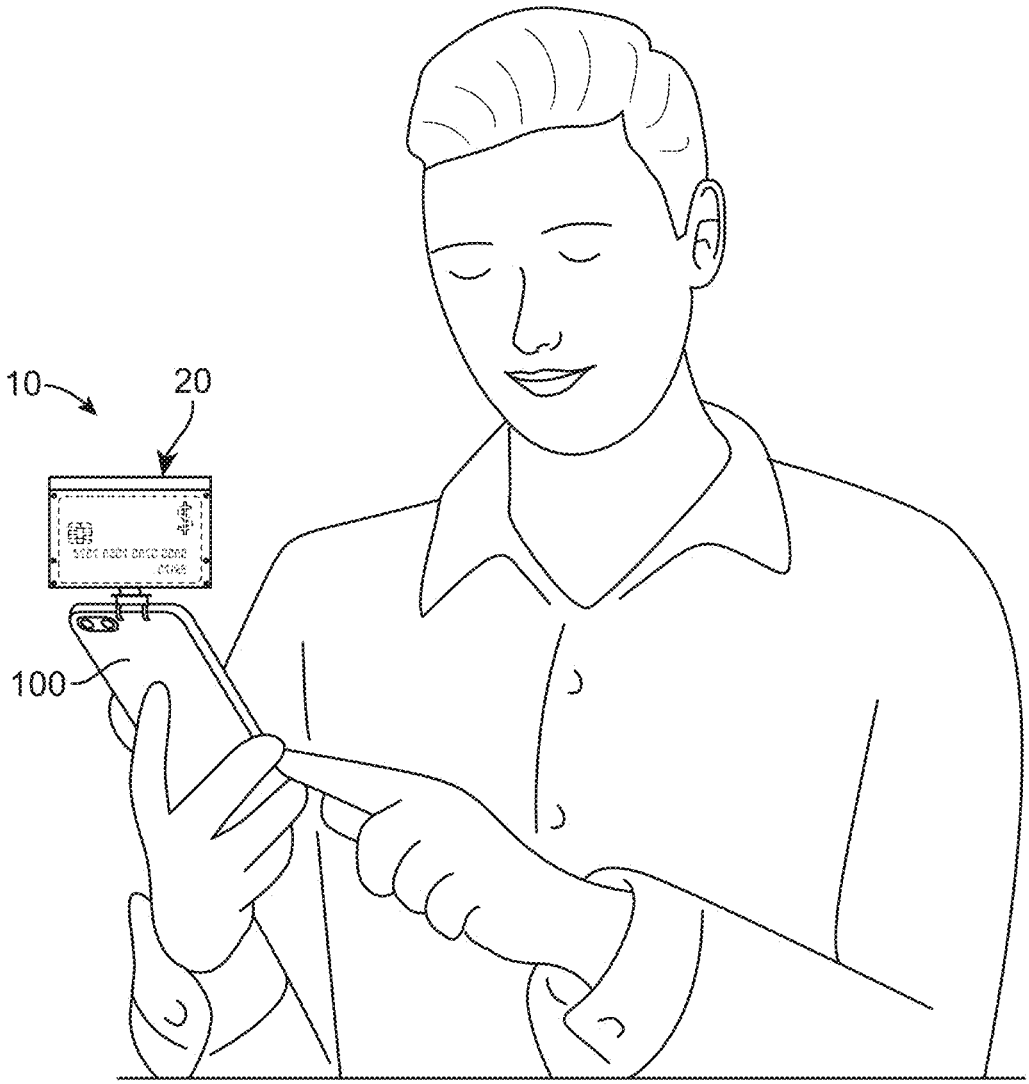
FIG. 1 represents an isometric operational view of the present invention 10 showing a user consulting card information from a bank card held in a card holder assembly 20 coupled to a computerized device 100.

Referring now to the drawings, where the present invention is generally referred to with numeral 10, it can be observed that it basically includes a card holder assembly 20 and a mounting assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 2:
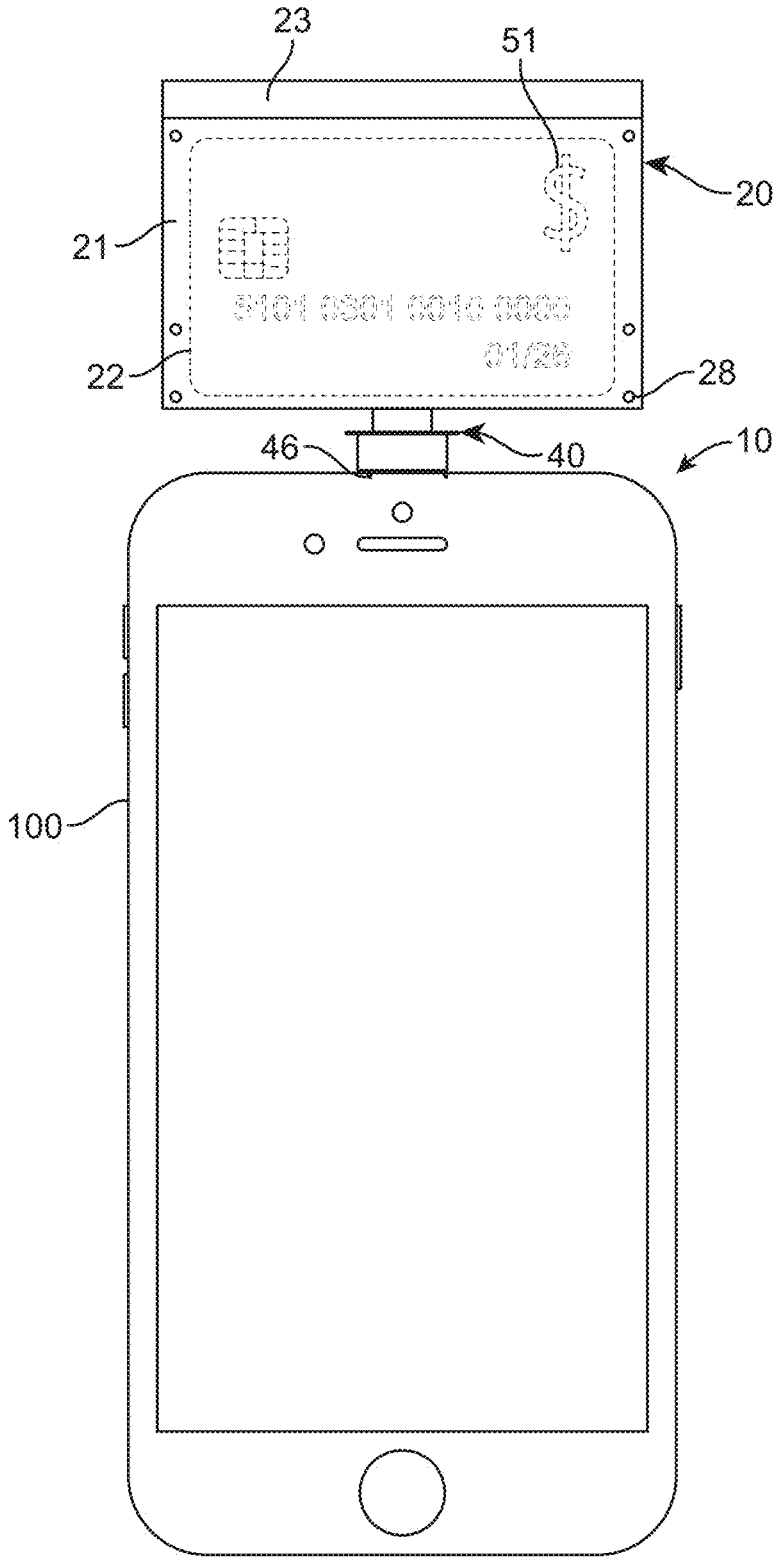
FIG. 2 shows a front view of the present invention 10 depicting the card holder assembly 20 with a first magnifying member 22 magnifying information of a card 51.
Figure 3:
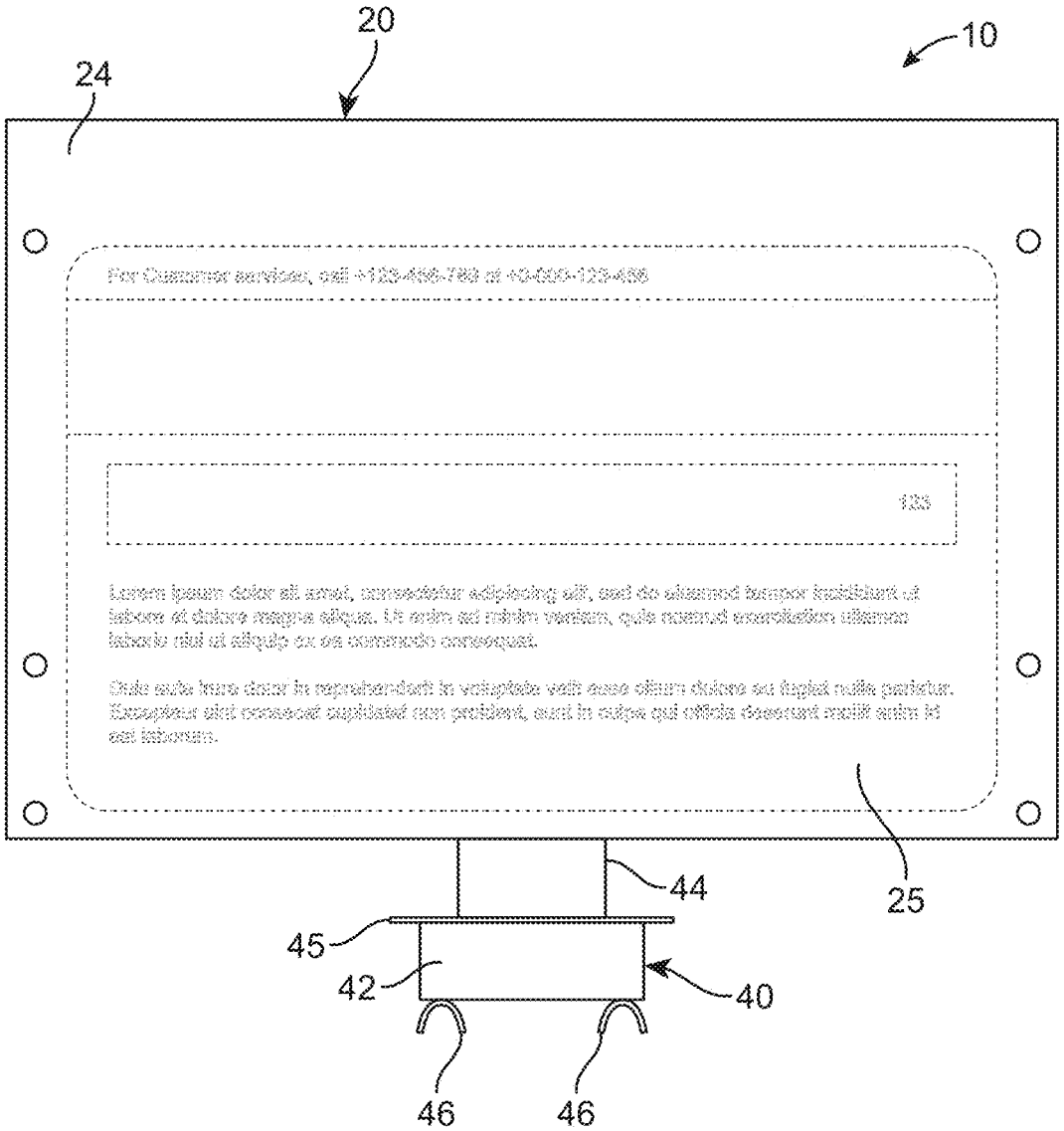
FIG. 3 illustrates a rear view of the present invention 10 showing a second magnifying member 25 located on a rear side 24 of the card holder assembly 20.

Best observed in FIG. 2 and FIG. 3, the card holder assembly 20 may have a substantially rectangular shape to receive cards therein. In other embodiments, the card holder assembly 20 may have other shapes such as oblong, polygonal, irregular shapes or any other suitable shape. In one of the preferred embodiments, the card holder assembly 20 may be made of a transparent plastic. In other embodiments, the card holder assembly 20 may be made of other suitable transparent materials. Preferably the card holder assembly 20 may be made of a hard material. The card holder assembly 20 may include a front side 21 and a rear side 24. The front side 21 and the rear side 24 may correspond to a first and a second layers of the card holder with bottom and lateral edges attached and with a central portion hollow to receive the cards therein. In one particular embodiment, the card holder assembly 20 may have a height of 2.5 inches, a length of 3.5 inches, and a width of ⅛ inch. In other embodiments, the card holder assembly 20 may have other suitable dimensions.

The front side 21 may have an opening 23 and a first magnifying member 22 as observed in FIG. 2. The opening 23 may be located on a top portion of the front side 21. The opening 23 may have the same length as a length of the card holder assembly 20. The opening 23 may allow slidably inserting a card 51 inside the card holder assembly 20. The front side 21 may further have a first magnifying member 22 located thereon to magnify the card information improving access and visibility of the card information. The first magnifying member 22 may be any suitable flat magnifying device known in the prior art. The card holder assembly 20 may further include lights 28 disposed in the card holder assembly 20 to improve visibility of the card information held by the card holder. In one embodiment, the lights 28 may be micro Light-Emitting Diodes. In other embodiments, the lights 28 may be any other suitable type of light. The lights 28 may be powered by a battery. The lights 28 and the first magnifying member 22 may define a card holding device for mobile phones with a magnifying device and an illuminated system. The lights 28 and the first magnifying member 22 may assist in reading of the card information of the card 51.

The rear side 24 may include a second magnifying member 25 attached thereon. The second magnifying member 25 may magnify the information of the rear side of the bank card such as the CVV code. A lower portion of the card holder assembly 20 may be attached to the mounting assembly 40. The mounting assembly 40 may basically include a first mounting member 42, a second mounting member 44, a pivot 45 and fasteners 46. The second mounting member 44 may be attached to the lower portion of the card holder assembly 20. The first mounting member 42 may be connected to the second mounting member 44 by the pivot 45. The pivot 45 may be a joint member that allows the rotation and tilt between the first mounting member 42 and the second mounting member 44, thus allowing the card holder assembly 20 to be tilted and rotated as desired. The card holder assembly 20 may be rotated to allow the user to read the card information from rear or front side of the card 51.

The fasteners 46 may be located on the lower portion of the first mounting member 42. The fasteners 46 may be hooks that allow snapping the card holder assembly 20 to a computerized device 100. The computerized device 100 may be a smartphone, a tablet, or any other computerized device. The card holder assembly 20 may be attached to the computerized device 100 to allow the users to easily read the card information of a card 51 while purchasing online or making banking transactions. The card 51 may be a bank credit or debit card. It also may be suitable to insert in the card holder assembly 20 other cards such as but not limited to gift cards.

Figure 4:
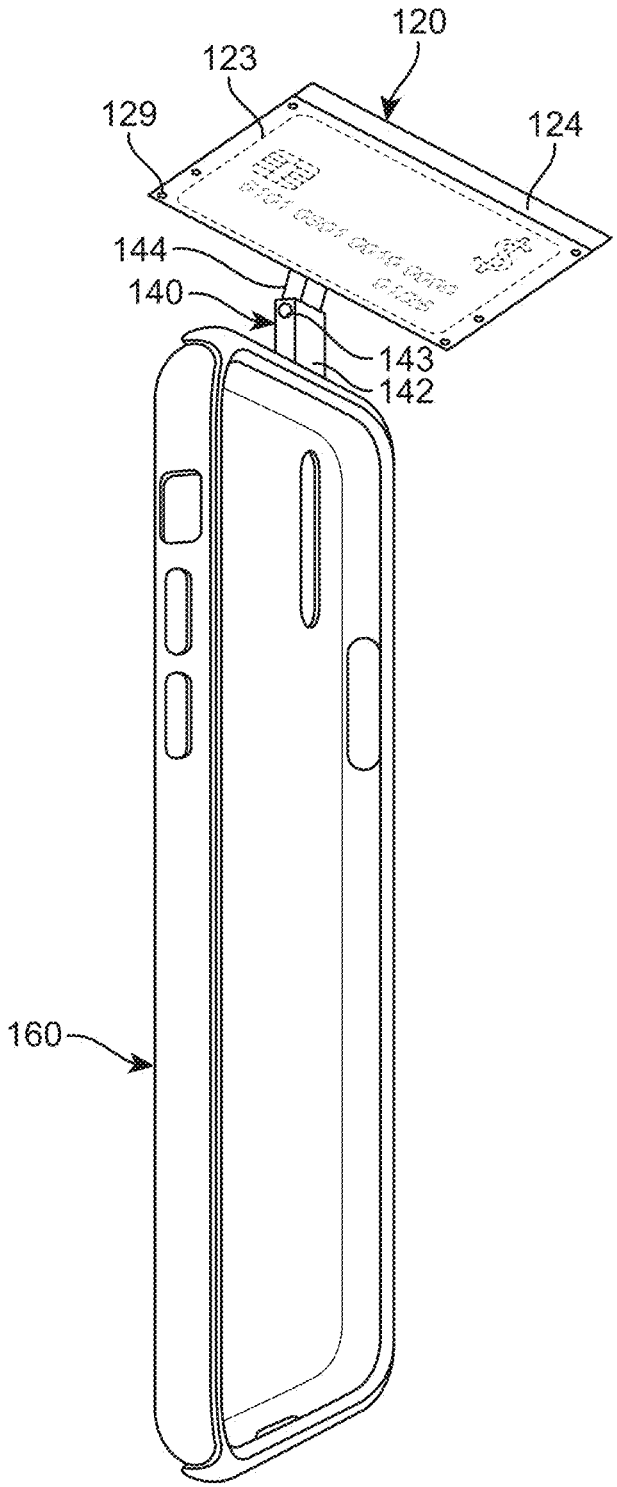
FIG. 4 is a representation of an isometric view of an alternative embodiment of the invention showing an alternative card holder 120 integrated to a case assembly 160 through a alternative mounting assembly 140.

Other embodiments of the present invention may include a card holder integrated to a mobile phone or to a mobile phone case. Best observed in FIG. 4, an alternative embodiment of the present invention may include a alternative card holder 120 with a alternative mounting assembly 140 integrated to a case assembly 160. The case assembly 160 may be any suitable case for smartphones or tablets. A top portion of the case assembly 160 may have the alternative mounting assembly 140 attached thereto.

The alternative mounting assembly 140 may include a 1first alternative mounting member 42 pivotally and rotatably attached to a second alternative mounting member 144 by a second pivot 143. The 1first alternative mounting member 42 may be attached to the case assembly 160. The second alternative mounting member 144 may be attached to a bottom portion of the alternative card holder 120. The alternative card holder 120 may include an alternative magnifying member 123, an alternative opening 124 and alternative lights 124. The alternative opening 124 may allow slidably inserting bank cards to into the alternative card holder 120. The alternative magnifying member 123 and the alternative lights 124 may improve reading of the card information.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A bank card holding device for mobile phones, comprising:

a. a card holder assembly having a substantially rectangular shape made of a transparent plastic, said card holder assembly including a front side and a rear side, said front side having an opening extending substantially a full length of said card holder assembly located on a top portion thereof configured to slidably receive a card therein, said front side further having a first magnifying member located thereon configured to magnify card information of said card, said card holder assembly further including lights powered by a battery disposed therein configured to illuminate said card information, said card holder assembly being integrated to a mobile phone case or configured to be attached to a mobile phone, said card holder assembly being configured to hold and display said card while magnifying and illuminating information displayed on said card through said transparent plastic; and b. a mounting assembly comprising a first mounting member, a second mounting member, and a pivot joint connecting said first mounting member to said second mounting member, said pivot joint configured to allow both rotation and tilt of said card holder assembly relative to said mobile phone, configured to pivotally attach the card holder assembly to the mobile phone; wherein said first mounting member has a rectangular shape; wherein said pivot is placed above said first mounting member, wherein said pivot is wider than said first mounting member; wherein said second mounting member is attached on top of said pivot, opposite to said first mounting member, wherein said second mounting member has a rectangular shape, wherein said card holder assembly is attached to a top end of the second mounting member; wherein said mounting assembly further includes two fasteners attached to a bottom edge of said first mounting member, wherein each fastener is located at lateral sides of said first mounting member, wherein said fasteners have a C-shape configured to secure said bank card holding device for mobile phones to a top edge of a mobile phone.

2. The bank card holding device for mobile phones set forth in claim 1, wherein the card holder assembly has a rectangular shape.

3. The bank card holding device for mobile phones set forth in claim 1, wherein the card holder is made of a transparent plastic.

4. The bank card holding device for mobile phones set forth in claim 1, wherein the front side has a first magnifying member located thereon, said first magnifying member is configured to magnify card information of the card.

5. The bank card holding device for mobile phones set forth in claim 1, wherein the card assembly includes micro light-emitting diodes embedded therein.

6. The bank card holding device for mobile phones set forth in claim 1, wherein the card assembly includes a rear side with a second magnifying member attached thereto.

7. The bank card holding device for mobile phones set forth in claim 1, wherein the mounting assembly has fasteners that allow mounting the card holder assembly 20 to the computerized device.

8. A bank card holding device for mobile phones, consisting of:

a. a card holder assembly having a substantially rectangular shape, said card holder assembly being made of a transparent plastic and comprising a first layer defining a front side and a second layer defining a rear side, said first layer and said second layer having bottom and lateral edges attached to one another and a central portion hollow therebetween configured to receive a card therein, said front side having an opening extending substantially a full length of said card holder assembly on a top portion thereof configured to slidably receive a standard-format card including at least one of a credit card, a debit card, and a gift card therein, said front side further having a first magnifying member located thereon configured to magnify card information displayed on a front surface of said card through said transparent plastic, said rear side having a second magnifying member attached thereto configured to magnify information displayed on a rear surface of said card including a CVV code, said card holder assembly further including micro light-Emitting Diodes powered by a battery disposed within said card holder assembly configured to illuminate said card information independently of said computerized device, said card holder assembly being configured to hold and display said card while magnifying and illuminating information displayed on said card through said transparent plastic; and b. a mounting assembly comprising a first mounting member, a second mounting member, fasteners located on a lower portion of said first mounting member configured to attach said mounting assembly to said computerized device, and a pivot joint connecting said first mounting member to said second mounting member, said pivot joint configured to allow both rotation and tilt of said card holder assembly relative to said computerized device, said second mounting member being attached to a lower portion of said card holder assembly, said mounting assembly being configured to pivotally attach said card holder assembly to said computerized device; wherein said first mounting member has a rectangular shape; wherein said pivot is placed above said first mounting member, wherein said pivot is wider than said first mounting member; wherein said second mounting member is attached on top of said pivot, opposite to said first mounting member, wherein said second mounting member has a rectangular shape, wherein said card holder assembly is attached to a top end of the second mounting member; wherein said mounting assembly further includes two fasteners attached to a bottom edge of said first mounting member, wherein each fastener is located at lateral sides of said first mounting member, wherein said fasteners have a C-shape configured to secure said bank card holding device for mobile phones to a top edge of a mobile phone.

* * * * *